United States Patent [19]

Boyer

[11] 4,133,388

[45] Jan. 9, 1979

[54] BALLAST CLEANING AND LEVELLING MACHINE

[76] Inventor: Jean-Jacques Boyer, Montchauvet (Yvelines), France

[21] Appl. No.: 804,156

[22] Filed: Jun. 6, 1977

[51] Int. Cl.[2] ..... E01B 27/06

[52] U.S. Cl. ..... 171/16; 37/107; 104/7 B; 241/101.7

[58] Field of Search ..... 104/2–4, 104/7 R, 7 A, 7 B; 37/104–107; 171/16; 241/101.7, 188 R; 299/7, 18

[56] References Cited

U.S. PATENT DOCUMENTS

| | | | |
|---|---|---|---|
| 1,034,552 | 8/1912 | Williams | 241/188 R X |
| 1,728,976 | 9/1929 | Nobis | 241/188 R X |
| 2,775,438 | 12/1956 | Bach et al. | 37/104 X |
| 3,329,350 | 7/1967 | Wisgerhof et al. | 241/188 R X |
| 3,670,972 | 6/1972 | Quinn | 241/101.7 X |

*Primary Examiner*—Albert J. Makay
*Attorney, Agent, or Firm*—Young & Thompson

[57] ABSTRACT

The present invention relates to ballast cleaning and leveling machines which ensure in succession the extraction of the old ballast, the screening of said ballast for separating the good re-usable ballast from the earth, the fine and the coarse parts, and the redepositing of the good ballast.

The improvement consists in adding between the excavator and the screening assembly a coarse crushing device acting on the old ballast removed by the excavator.

The improved machine breaks apart the pebbles of the agglomerated blocks of the ballast so as to separate the re-usable ballast from the earth, fine and coarse parts to be rejected.

2 Claims, 2 Drawing Figures

BALLAST CLEANING AND LEVELLING MACHINE

The present invention relates to ballast cleaning and levelling machines which ensure in succession the extraction of the old ballast, the screening of said ballast for separating the good re-usable ballast from the earth, the fine and the coarse parts, and the redepositing of the good ballast.

These machines of known type comprise generally at least a clearing excavator, elevating devices, at least one screening assembly and conveyors for on the one hand evacuating the spoil and on the other hand bringing back the good ballast to the railway road bed.

However, railway restoration poses problems in certain countries such as the United States of America where the tracks have not been renovated since their construction and the maintenance has been limited to additions of ballast. In such a case, the ballast layer is agglomerated by the earth and clay which crept between the pebbles and by the material fallen from the trains running on the track. The result is that the clearing excavator extracts agglomerated ballast blocks which are rejected by the screeners, with the consequence that the recovery of old ballast is almost non existent.

The aim of the present invention is to remedy such a disadvantage and its object is the provision of a ballast cleaning and levelling machine of the type comprising a clearing excavator extracting the old ballast, elevating conveyors carrying the old extracted ballast to a screening assembly and conveyors evacuating the screening spoils and bringing back the recovered good ballast to the part of the railway road bed which has been previously cleared by the excavator, characterized in that it comprises between the excavator and the screening assembly a coarse crushing device acting on the old ballast removed by the excavator.

The crushing device added according to the invention breaks the agglomerated ballast blocks, but if the crusher is coarse, its action is limited to the disaggregation of the hardened matters encasing the ballast pebbles which offer a mechanical strength lower than that of the pebbles.

According to a preferential embodiment, the crusher is formed with a vertical shaft mounted beyond and in the vicinity of the discharge end of an elevating device, and rotatively driven by a known driving device, said shaft carrying, through flexible connections, percussion masses.

With this embodiment, the percussion masses which may be in the form of cast iron or steel balls are projected at high speed into the agglomerated ballast stream where they strike the blocks which break into smaller parts under the effect of the impact.

Figure 1:
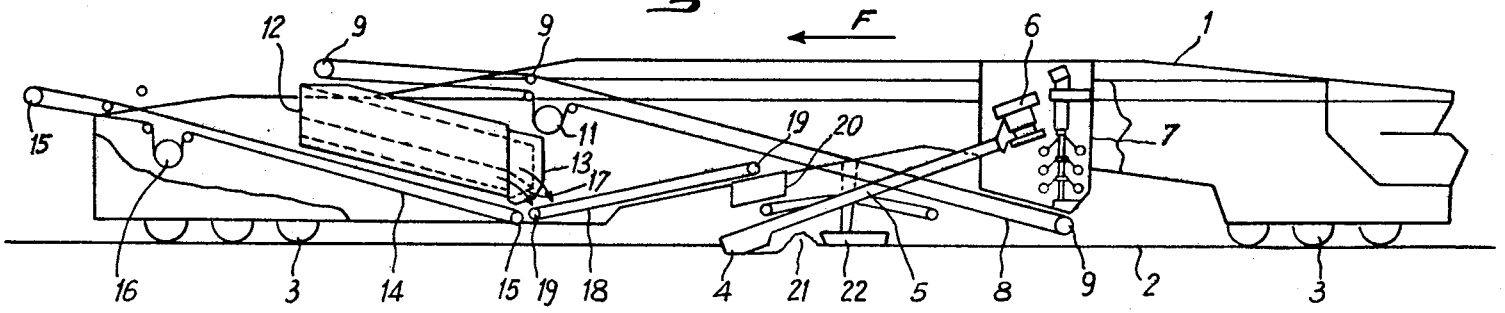
Figure 2:
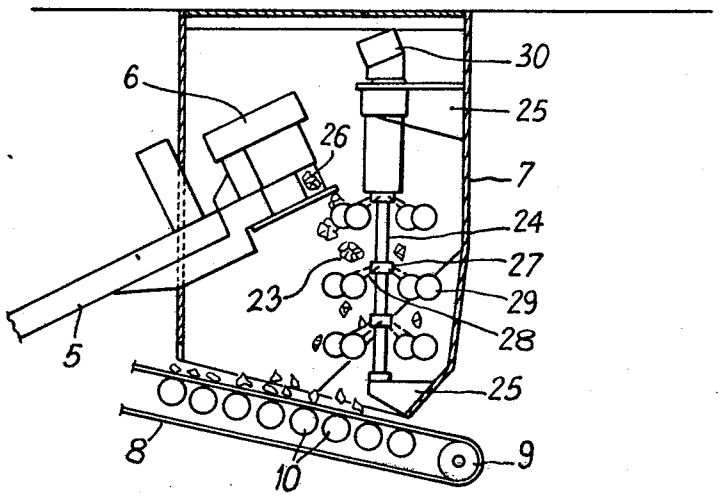

The invention will become more apparent from the following description of one embodiment thereof when taken in conjunction with the accompanying drawing wherein:

FIG. 1 is a schematic lateral partially broken out view of the whole assembly, of the machine, and, FIG. 2 is a cross-sectional view on a larger scale of the hopper in which is mounted the crusher.

The ballast cleaning and leveling machine shown in FIG. 1 is of the type wherein the machine 1 which runs on the track 2 to be renewed in the direction of arrow F is carried by bogies 3, lifts the track, that is the rails and ties, by a known lifting device of the electromagnetic type or of the type with roller grippers, not shown, and removes the ballast with a transverse excavator 4 under the track part which has been lifted. The invention is also applicable to machines repairing the ballast bed after removing of the track.

In the machines of the described type, the buckets of the excavator pass transversely under the lifted part of the track and move upwards laterally inside a channel 5 while being driven by a motor 6 for discharging the ballast in a hopper 7. The ballast is recovered at the base of said hopper on a main conveyor 8 guided and supported by rollers 9 and 10 and driven by a cylinder 11 in order to be discharged at the top of screener 12. In this screener, the coarse blocks are separated and brought back by a hopper 13 at the base of the screener on a spoil conveyor 14 guided by rollers 15 and driven by a cylinder 16 which evacuates them. Similarly, the smaller blocks which have gone through the various hoppers of the screener fall on spoil conveyor 14 and are evacuated. On the other hand, the good ballast comes out at 17 and falls on a storage conveyor 18 guided and driven by rollers 19, which discharges it into a chute 20 from where it falls back onto the railway platform behind the excavator at 21 in order to be levelled by a levelling device 22.

As hereabove discussed, the ballast to be found in some tracks to be renewed is agglomerated and this old ballast is extracted and discharged into the hopper in the form of blocks 23 comprising several ballast pebbles. In the aforedescribed known machine, the old ballast would be entirely evacuated at 13 with the coarser pebbles. According to the invention, a crushing device is mounted in hopper 7 and comprises a vertical shaft 24 carried by brackets 25 in order to be substantially in register with the discharge opening 26 of the excavator. On said shaft are mounted rings 27 carrying balls 29 through chains 28. In the shown embodiment, the crusher comprises three rings carrying four balls each, but this arrangement may be different. Shaft 24 is rotatively driven by a motor 30 which may be a hydraulic motor. Preferably, and as the excavator discharges the old ballast into the hopper with a certain transverse component, the rotation direction of the crusher is such that the speed of the balls, in the part of their path which is under chute 26, is opposed to that of the transverse component, the effect being an increase of the collision probabilities. Under the effect of these impacts which should not be too strong in order not to break the ballast pebbles, the layers of matter which agglomerate the pebbles are broken and the pebbles are individualized, the rubbing of the pebbles against each other on conveyor 8 and the rubbing occurring in hopper 12 being sufficient to detach the foreign particles which may still adhere to the ballast pebbles.

The hereabove embodiment which has been described as an example may receive various modifications without departing from the scope of the invention such as defined by the attached claims.

I claim:

1. A ballast cleaning and levelling machine for removing old ballast from a railway road bed and for separating spoil from cleaned ballast, comprising at least a clearing excavator, elevating means, at least one screening assembly and conveyors for on the one hand evacuating the spoil and on the other hand returning the cleaned ballast to the railway road bed, said machine further comprising between the excavator and the screening assembly a coarse crushing device acting on the old ballast removed by the excavator.

2. A ballast cleaning and levelling machine according to claim 1, wherein the crusher is comprised by a vertical shaft mounted beyond and in the vicinity of the discharge of the elevating device and rotatively driven by a known driving device, said shaft carrying percussion masses through flexible connections.

* * * * *